US005159723A

United States Patent [19]

Benedict

[11] Patent Number: 5,159,723

[45] Date of Patent: Nov. 3, 1992

[54] BATHTUB

[76] Inventor: Ray B. Benedict, P.O. Box 336, Buffalo Creek, Colo. 80425

[21] Appl. No.: 812,046

[22] Filed: Dec. 23, 1991

[51] Int. Cl.[5] ..... A47K 3/00

[52] U.S. Cl. ..... 4/584; 4/538; 4/595; 52/34; 52/35

[58] Field of Search ..... 4/584, 595, 612, 613, 4/538; 52/34, 35

[56] References Cited

U.S. PATENT DOCUMENTS

| | | | |
|---|---|---|---|
| 1,615,881 | 1/1927 | Lucke | 4/595 |
| 1,704,105 | 3/1929 | Sauer | 4/538 |
| 1,939,115 | 12/1933 | Fritsche | 4/538 |
| 1,993,420 | 3/1935 | Steele et al. | 4/595 |
| 2,143,034 | 1/1939 | Sakier | 4/538 |
| 2,267,513 | 10/1940 | Waterman | 4/538 |
| 2,350,790 | 6/1944 | McCarthy | 52/35 |
| 2,397,690 | 4/1946 | Pawlus et al. | 4/538 |
| 2,526,883 | 10/1950 | LaBarre | 4/538 |
| 3,299,444 | 1/1967 | Gangelhoff | 52/34 |
| 3,359,574 | 12/1967 | Stoneburner | 4/595 |
| 3,745,733 | 7/1973 | Litvin et al. | 52/34 |
| 3,827,086 | 8/1974 | Seymour | 4/584 |
| 4,080,710 | 5/1978 | Hess | 4/538 |
| 4,204,376 | 5/1980 | Calvert | 52/35 |
| 4,290,154 | 9/1981 | Benjamin | 4/584 |
| 4,691,392 | 9/1987 | Whitney | 4/595 |
| 4,829,731 | 5/1989 | Schulter | 52/287 |

FOREIGN PATENT DOCUMENTS

| | | | |
|---|---|---|---|
| 568363 | 12/1958 | Canada | 52/288 |

*Primary Examiner*—Henry J. Recla
*Assistant Examiner*—Thomas Sweet

[57] ABSTRACT

An improved bathtub, having a wall form and an adjoining base form, both of which are an integral part and made from the same material as the bathtub. The wall form extends lengthwise the full extent of the upper back bathtub planar surface and at right angles along the end planar surfaces, then at right angles down both ends of the bathtub front wall to the floor level, where, at right angles, the base form is joined at each end of the bathtub. The bathtub wall form provides the following: a secure means of attaching the bathtub to the structural wall members, an improved tapering wall or flange that eliminates the bulge where drywall and the upper flange of the bathtub meet, a means of holding the drywall edge away from the planar surface of the bathtub, and a wall tile groove. The base form provides a unique method of sliding the floor covering up and into the lower portion of the front bathtub wall, thus eliminating the normal cut or abutted joint found at the base of the bathtub front wall. An improved bathtub, where all lines of contact between the bathtub and surrounding adjacent surfaces are relocated where they are covered and protected from water penetration.

7 Claims, 6 Drawing Sheets

PRIOR ART

BATHTUB

BACKGROUND

1. Field of Invention

This invention relates to new and unusual water repelling forms manufactured within a molded or cast bathtub, and specifically to the areas where the bathtub comes into contact with adjacent vertical or horizontal surfaces.

2. Description of Prior Art

Water penetration of the crack between a bathtub and surrounding adjacent walls and flooring is presently, as it has been in the past, a consistent service, maintenance, and repair problem. There are three major problem areas, all of which have been the target of a multitude of ideas on how to solve them. Some solutions have been partially successful, whereas most have sought a solution in covering up rather than eliminating the problems. The first problem is that of water running down the front face of the bathtub wall and penetrating the space or crack where the base of the bathtub abuts the floor covering surface. Next is the problem of water penetration at the line of contact between the wall and the upper planar surface of the bathtub along the back wall and along each end wall. The third area of concern is at each end of the bathtub, along the rounded corners and down the front ends to the floor. It can still be said, the watertight integrity of all lines of contact between a bathtub, the walls surrounding it, and the flooring abutting it are only as good as the caulk filling them.

Since the bathtub was removed from its legs and was placed on the flooring, adjacent to a wall or walls, inventors have created several methods of attaching or anchoring the bathtub to back and side walls. U.S. Pat. No. 1,615,881 to Lucke (1927) discloses an L-shaped wall bracket mounted to the structural members of a wall on which the downward edge of the bathtub rim is set. Plaster or wallboard is then installed over the bracket and abutted to the upper bathtub surface. This installation method is difficult and does not protect the adjacent walls from moisture. U.S. Pat. No. 1,704,105 to Sauer (1929) shows a bathtub having a rim or wall flange portion which may be imbedded in the wall finish. Here, the mounting bracket, as shown, provides good wall mounting qualities, however the plaster or wallboard is directly exposed to the moisture of the bathtub planar surface, thus having no waterproofing or moisture repelling qualities. U.S. Pat. No. 1,939,115 to Fritsche (1933) discloses an L-shaped wall mounting bracket with an under portion of continued overlapping folds ending with a plurality of suspended hooks for supporting the bathtub wall. A packing of sorts is contained at the bottom of the lower fold, which sits on the upper edge of the bathtub. The weight of the bathtub would bear down on the supporting hooks and pull downwardly on the overlapping fold of metal and let the bathtub settle where it may. The waterproofing is then lost, exposing a wide and unsightly folded metal form which runs the length of the bathtub back and end planar surfaces.

Of more recent vintage, U.S. Pat. No. 4,204,376 to Calvert (1980) depicts a finished strip adapted to engage a wall and the upward flaring flange of a bathtub. This invention shows a molding attached over the bathtub flange wherein a nail is driven through the molding and the bathtub flange and into the wall. The lower extended portion of the molding is then folded up to overlap and snap onto the back molding section, thus covering the nail heads. No way is provided of eliminating the fracturing and splitting of the bathtub flange as the nails or screws are inserted. The upper portion of the molding provides a relatively flat surface to abut drywall and or wall covering to, however the ever enduring crack line between bathtub and wall is only raised slightly and will still require caulking of some sort. U.S. Pat. No. 4,290,154 to Benjamin (1981) provides a somewhat complicated wall mounting bracket that is attached to the downwardly turned flange or skirt of a bathtub and then anchored to the wall with nails or screws. The drywall and or wall covering is then set onto an outwardly running rib that sits on top of and at the back of the bathtub planar surface. This rib provides a resting place for the drywall and wall covering but still leaves the edge portion of both at the planar level, where grouting is essential. U.S. Pat. No. 4,691,392 to Whitney (1987) shows another molding for supporting a plastic bathtub to the wall and of overlapping this molding with a piece of decorative molding. This molding precludes the use of wall tile and the like and provides no waterproof joint at its upper surface.

U.S. Pat. No. 2,143,034 to Sakier (1939) and U.S. Pat. No. 4,829,731 to Schulter (1989) both show wall mounted brackets that adapt above the back planar surface of a bathtub, wherein both support the wall covering and or drywall at or slightly above the bathtub planar surface. Neither molding bracket supports the bathtub, and both rely on a filling of cement, rubber or plastic molding, or adhesives to provide their waterproofing. With neither molding has the need for grout or caulking been eliminated.

U.S. Pat. No. 3,827,086 to Seymour, et al. (1974) and U.S. Pat. No. 4,080,710 to Hess (1978) show bathtubs with wall enclosures that do provide adequate watertight joints where their preformed walls join the bathtubs. However, they require nesting, bolting, or other joining means that would be of no use to a bathtub intended for use without these preformed walls. We have shown a history of wall mounting devises and water repelling ideas that in one way or another fall short of consumer needs.

Attention is now turned to the waterproofing needs at the base of the front wall of the bathtub. U.S. Pat. No. 1,615,881 to Lucke (1927) shows a metal plate extending along the edge of the bathtub front wall, at the base, which has a pocket filled with an elastic tar-like sealing substance.

U.S. Pat. No. 2,526,883 to La Barre (1950) shows an extensive labor intensive bathtube base form that requires the laying of the wood flooring after the bathtub is set on the subfloor. It further requires a large amount of adhesive or grout that would be very difficult to induce behind the molding. In both figures, as shown by La Barre, the floor covering abuts the face of the steel structure at the base of the bathtub. Moisture will penetrate this joint and seep under the floor covering onto the steel structure and then onto the flooring. The use of caulking has not really been eliminated. U.S. Pat. No. 2,267,513 to Waterman (1940) shows a bathtub front wall base where the floor covering material is coved upward under the face wall of the bathtub. This patent requires the cutting and fitting of some or all of the following: an angle metal strip; a flexible sheet such as lead, copper, waterproof fabric, or the like; as well as structural lumber and or wood cove stick. This is a very labor intensive concept that does not properly protect the upper edge portion of the floor covering from moisture. The upper edge portion of the floor covering is also not sufficiently held into the back wall, and no accommodation for waterproofing at the ends of the bathtub base is provided.

Canadian Patent 568,363 to Magee (1958) shows a one-piece molding which is applied to the junction of the wall and floor for use in construction of buildings of fire resistive construction, in order to achieve a straight, true, and level plaster wall to floor finish treatment. Magee does not claim any waterproof properties, nor do I feel it can be shown he intended or anticipated the use of this invention attached to the structure of a bathtub base. Were it used as such, it would be found to have many shortcomings.

One experienced in the installation of flexible floor covering material is knowledgeable of the following. The vinyl floor covering used today is highly susceptible to expansion and contraction with changes in temperature and humidity. It is therefore of uppermost importance to provide an adequate surface, sufficient adhesive, and proper pressure of floor covering into adhesive and onto the area being covered in order to achieve proper bonding. If even one of these three requirements is not met, the floor covering will not fully bond, and in time, improperly adhered portions will expand and contract until they blister or crack, at which point the waterproofing quality is lost, and replacement is necessary. Metal molding and plastic surfaces are poor bonding materials for floor covering adhesive. The Magee patent did not allow for these needs. As floor covering is inserted in and up a cove, it tends to lay over at the top edge, and it is difficult to hold it tightly into the upper back wall while the adhesive cures. The Magee patent did not provide for this. The depending lip, the metal edge protruding downward which overlaps the end section of the floor covering, is thin and sharp of edge and can catch the upwardly forced floor covering and create difficulties for the installer. Briefly, the Magee molding is not user friendly and can stand major improvements, as can the previous cove molding shown by Waterman.

OBJECTS AND ADVANTAGES

The primary object of my invention is to provide a bathtub to the hotel, motel, and home owner that will do away with the need for caulking at the top planar surface, the front end walls, and at the line where the bathtub base meets the floor covering. In doing this, the unsightly, labor intensive, and ineffective grouting of these problem areas will be eliminated. In their place will be effective, clean, strong, water repelling lines of contact that will be virtually trouble free.

Accordingly, besides the objects and advantages of my invention described above, several objects and advantages of the present invention are:

(a) To provide a bathtub that, during rough-in, will be easy and quick to install, that will not require additional labor and material to enhance its appearance or water repelling qualities.

(b) To provide a bathtub with improved wall anchoring capabilities at the back, at the ends, and most importantly, at the rounding front end corners, and down both bathtub end walls, and to further provide mounting capabilities that lessen to a substantial degree the settling down and away from the walls of the bathtub.

(c) To provide a bathtub that will offer adequate overlapping support for the installation of drywall and eliminate the loose, ill fitting joints normally found at the rounding front corners and down both bathtub front end walls.

(d) To provide a bathtub that will make the drywall installer's work easier and quicker by providing straight lines and right angle corners, providing an improved end product.

(e) To provide a bathtub with a drywall abutting shelf that will hold the drywall end portion away from all surfaces of a bathtub normally associated with water.

(f) To provide a bathtub with a built-in wall tile groove that will receive and hold the lower edge portion of the tile in such a manner so as to eliminate the need for grout or caulking.

(g) To provide a bathtub that will, because of its straight lines, right angle corners, and built-in tile groove, provide the wall covering installer with vastly improved working conditions with a resulting superior end product.

(h) To provide a bathtub with a built-in channel at the base of the front wall that will receive the edge portion of a flexible floor covering. A channel constructed as to provide adequate holding and bonding of the floor covering, thus eliminating early replacement problems.

(i) To provide a bathtub with a concealed line of contact where the front wall of the bathtub and the floor covering join; a line of contact so removed from the exposure of water that caulking will never be needed.

(j) To provide a bathtub with built-in waterproof corners at both ends of the bathtub front wall base where the walls, the floor covering, and the bathtub all join.

(k) To provide a bathtub for the consumer that will deliver the watertight integrity presently found only in preformed plastic bathtubs and wall installations; a bathtub that will give the purchaser the ability to draw from the vast supply of colors, styles, patterns, and types of wall and floor covering available today, while not giving up the needed waterproofing qualities.

Further objects and advantages are to provide a bathtub that is installer and user friendly. This bathtub will eliminate for the installer the need for separately mounted supporting wall brackets, the need to add moldings, decorative trim or other water repelling forms, or the need for caulking at any line of contact between the bathtub and its adjoining horizontal or vertical surfaces. Still further objectives and advantages will become apparent from a consideration of the ensuing description and drawings.

BRIEF DESCRIPTION OF THE DRAWING FIRGURES

In the drawings, closely related figures have the same number.

Figure 2A:
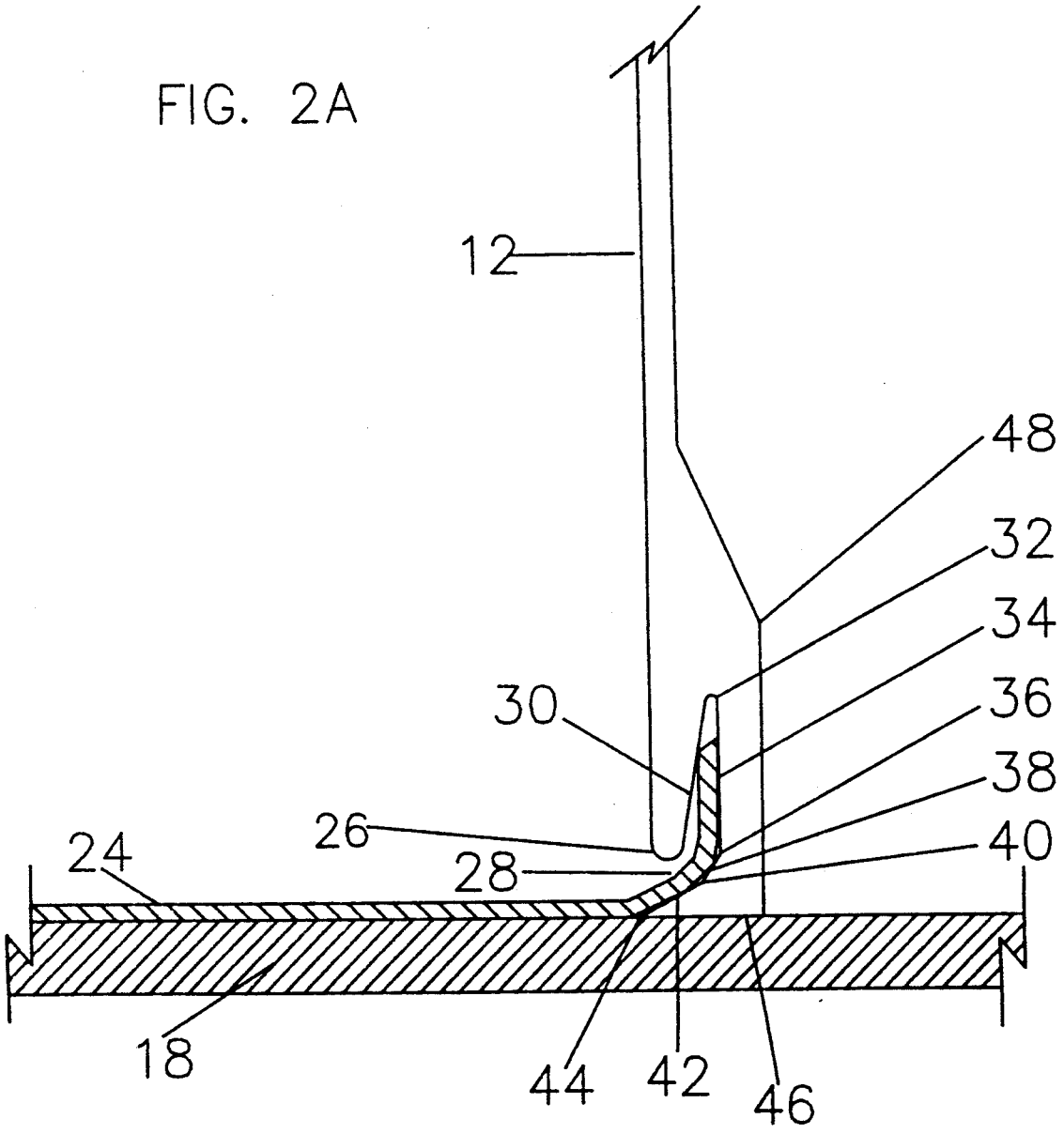
FIG. 2A is a schematic diagram, taken substantially upon a plane passing along section line 2—2 of FIG. 1, illustrating a cross-section, partially fragmented view of the front bathtub base form, showing how the floor covering is flashed upward and inward in accordance with the present invention.
Figure 2B:
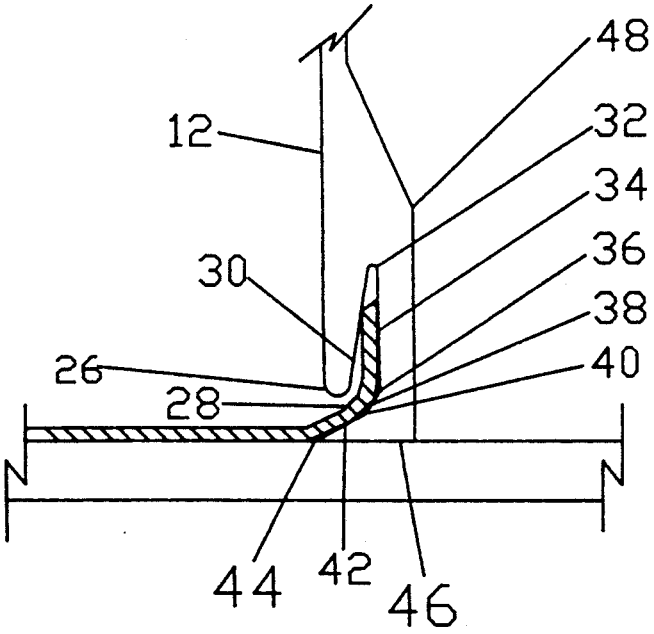
Figure 2C:
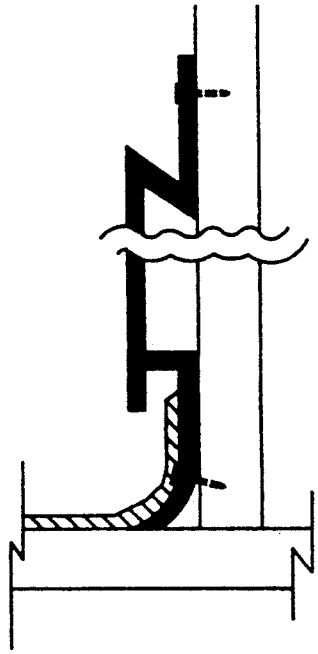

FIGS. 2B and 2C show the enlarged cross-sectional views, side by side, of the Canadian Patent 568,363 to Magee (1958) and my bathtub base form as shown in FIG. 2A. The entirety of the Magee patent is improved to such a degree as to make it impossible to show the usual improved portions disconnected from the old structure. I have taken the liberty of showing both, side by side, so as to make the comparison study easier for the reader.

Figure 1:
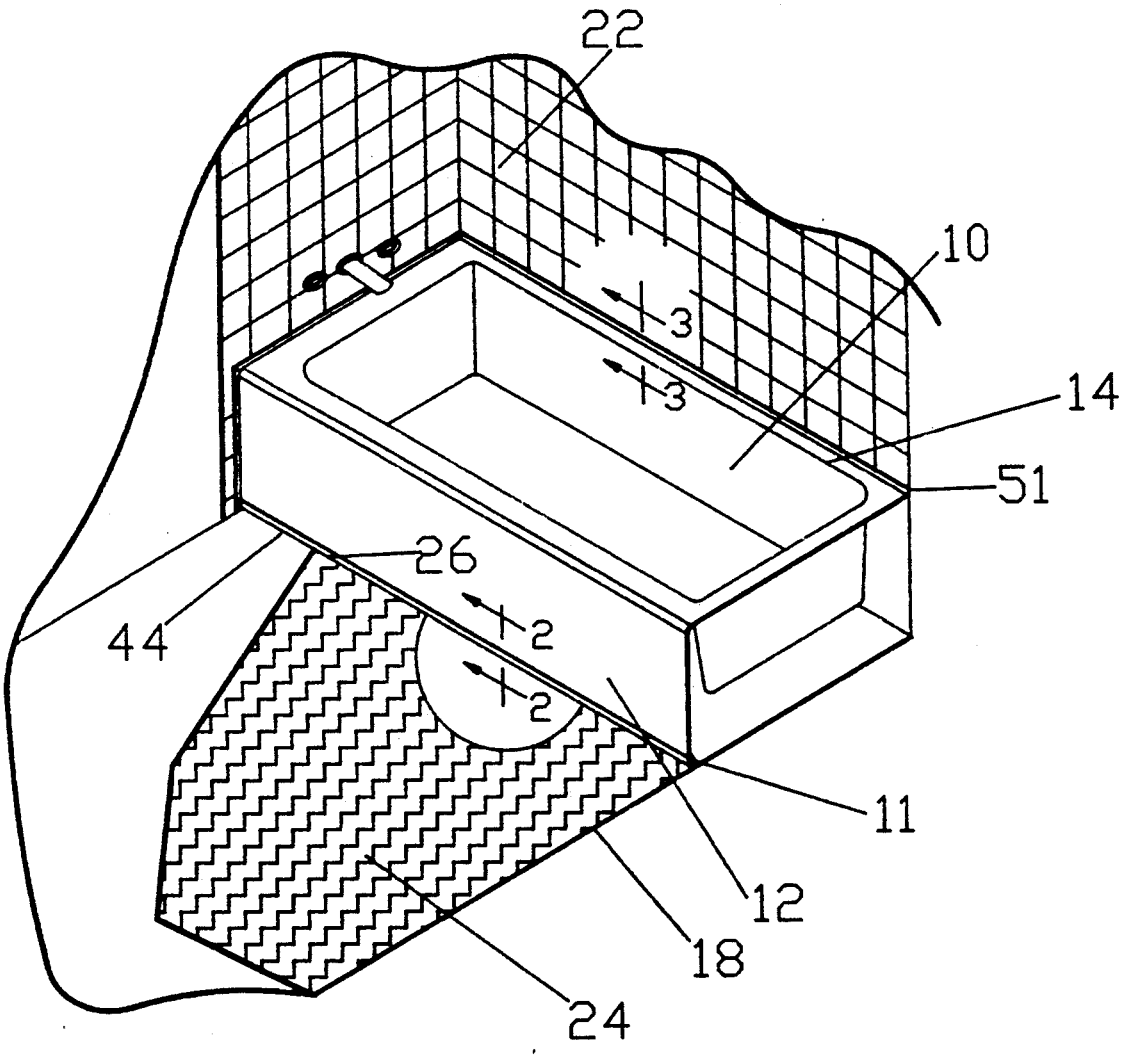
FIG. 1 is a schematic diagram illustrating a perspective view of an improved bathtub as it relates to the drywall, wall covering, floor, and floor covering in accordance with the present invention.
Figure 3:
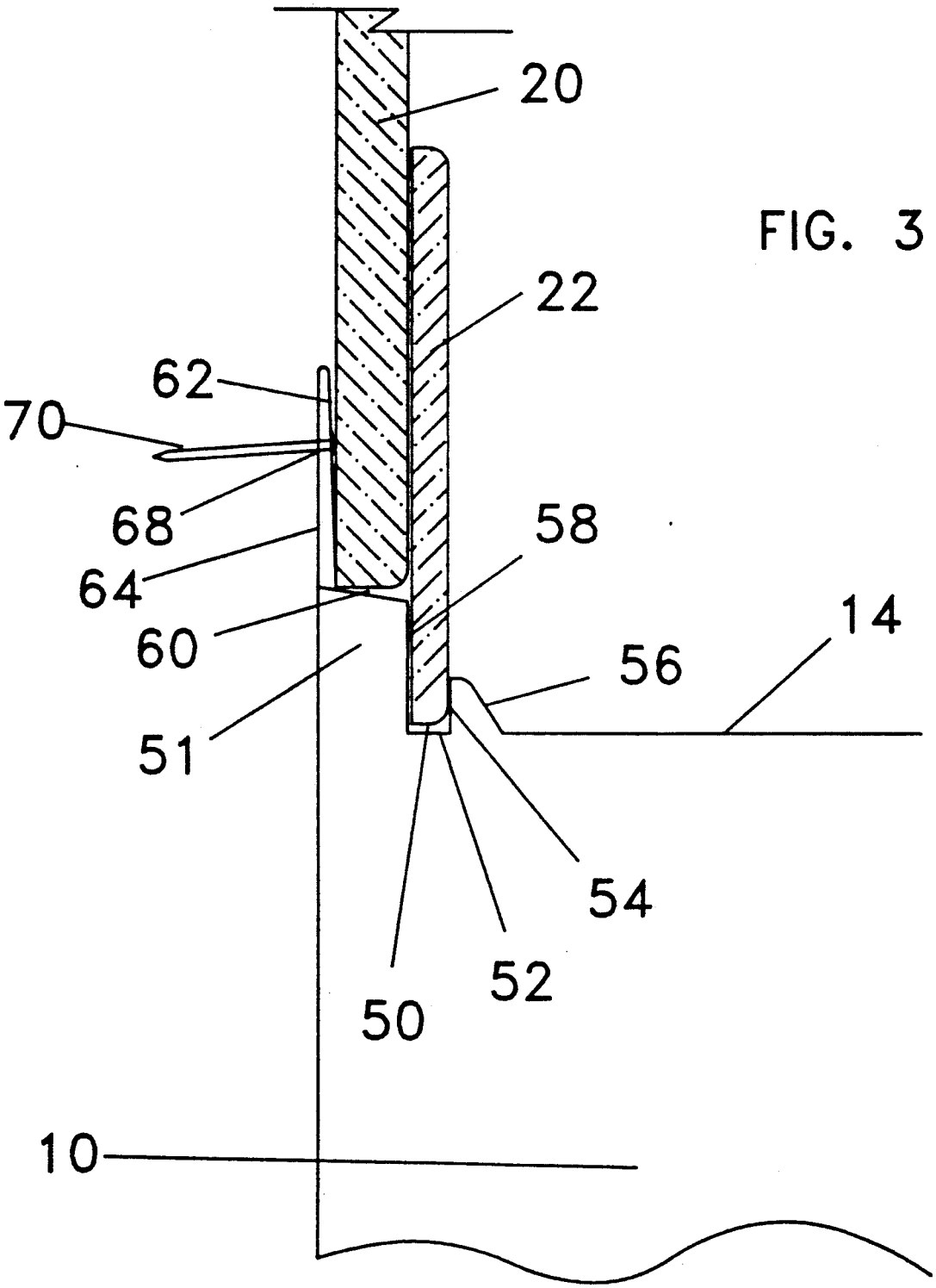

FIG. 3 is a schematic diagram, taken substantially upon a plane passing along section line 3—3 of FIG. 1, illustrating a cross-sectional, partially fragmented view of the bathtub wall form feature, showing how the bathtub is adapted to the wall and how the drywall and wall tile fit to the bathtub wall form.

Figure 4:
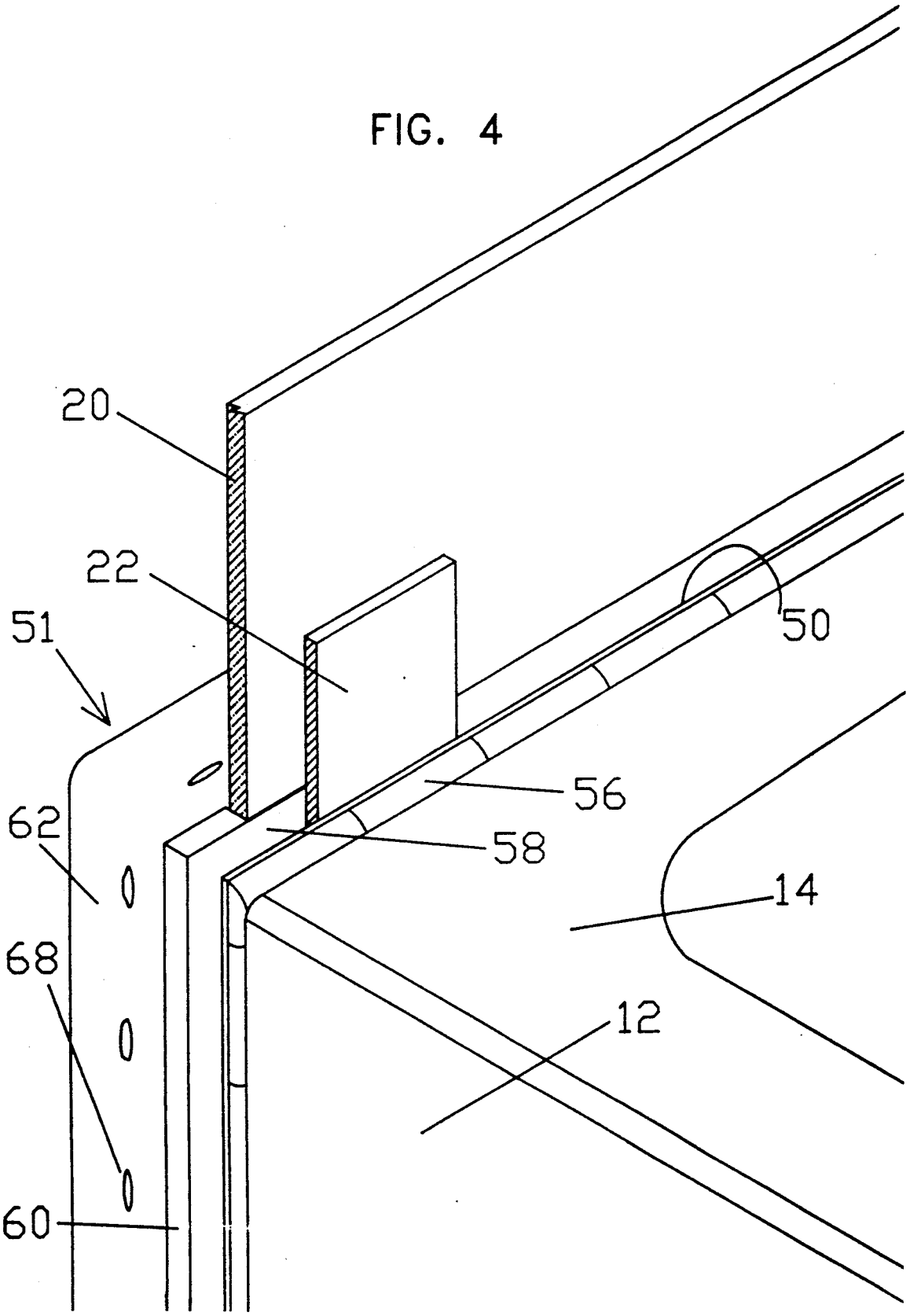

FIG. 4 is a schematic diagram illustrating a cross-sectional, partially fragmented view of the right angle, downwardly existing wall form, showing how it relates to the face and the upper bathtub plane, and how the drywall and wall tile relate to the wall form.

Figure 5:
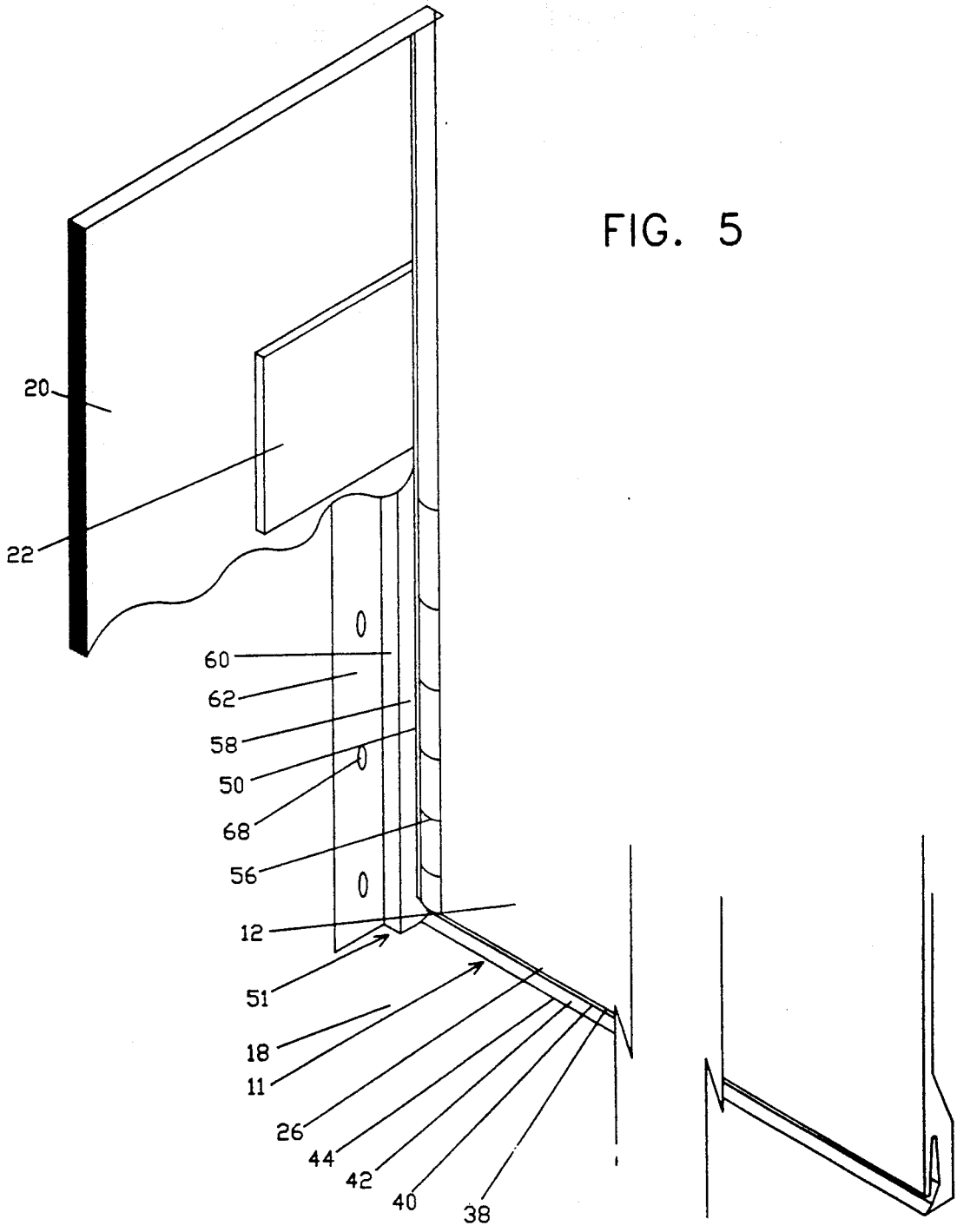

FIG. 5 is a schematic diagram illustrating a perspective, partially fragmented view of the joining at the floor level of the bathtub wall form and base form and how the drywall, wall tile, and floor covering relate to each other and to the bathtub.

REFERENCE NUMERALS IN DRAWINGS

10 bathtub
11 base form
12 bathtub front wall
14 bathtub upper planar surface
16 wall studs
18 flooring
20 drywall
22 wall tile
24 floor covering
26 smooth, rounded depending lip
28 base form channel
30 smooth tapered upper inside wall
32 compound inside angle joint
34 upper portion of sectionally divided back wall
36 joint-creating adhesive trough
38 center portion of sectionally divided back wall
40 joint-creating adhesive trough
42 lower portion of sectionally divided back wall
44 tip of base and sectional back wall
46 flat base
48 back inside wall from tub base to upper wall
50 wall tile groove
51 wall form
52 bottom surface of wall tile groove
54 inside front tile groove wall
56 front tile groove wall
58 back tile groove wall
60 sloped drywall shelf
62 tapering back wall
64 bathtub back wall
68 slotted anchoring holes
70 anchoring screw or nail

DETAILED DESCRIPTION—FIGS. 1-5

Referring to FIG. 1, there is shown a bathtub 10 supported on flooring 18. The bathtub has a front wall 12, an upper planar surface 14, a wall form 51, and a base form 11, all constructed in accordance with the present invention. The bathtub would typically be molded or cast of plastic, fiberglass, or steel. The wall form and base form are made as an integral part and of the same material as the bathtub. The wall form extends lengthwise the full extent of the upper back bathtub planar surface and at right angles along the end planar surfaces, thence at right angles down both ends of said bathtub front wall to the floor level, where, at right angles, the wall form joins the base form at each end of the bathtub. A pattern of wall tile 22 is shown with the lower row of the having been inserted into the wall form at the planar surface of the bathtub. The stacks of wall tile shown at the face of the bathtub front wall are also inserted into the wall form. A sheet of flexible floor covering 24 is shown adhered to the flooring, as well as being extended upwardly over the tip of the lower portion of the sectionally divided back wall 44 and into the base form along the front of the bathtub. The upper edge portion of the floor covering is shown extending behind the smooth, rounded depending lip portion 26 of the bathtub front wall.

Referring now to FIG. 2A, which shows a cross-section of the front wall of said bathtub being supported by a flat base 46. The flat base is joined to a back wall frame 48 that continues upwardly and inwardly to form the back side of the bathtub front wall. The smooth, rounded depending lip at the lower portion of the bathtub front wall joins a tapered upper inside smooth wall 30, which flares in rearwardly and upwardly, where it joins the upper portion of a back sectionally divided wall 34 at an acute inside angle 32. These components comprise the upper inside wall of the inverted channel 28 that is cut or molded into the bathtub at the time of manufacturing. The channel, being defined by the opposed, spaced, inside upper tapering wall and the sectionally divided inside back wall. The channel has an opening at the bottom or lower end of the front bathtub wall between the smooth, rounded depending lip and the angled front base tip, where the back inside wall begins. The lower portion 42 of the inside back wall extends inwardly and upwardly at approximately thirty degrees to the joint 40, where the center back wall portion 38 continues upwardly at an additional thirty degrees, or so, angle. The center back wall portion then continues at the approximate thirty degree angle, joining the back wall surface at joint 36. The completed channel is sized and shaped to slidably receive an upwardly extended edge portion of a flexible floor covering. The channel opening defined by the overhanging edge of the smooth, rounded depending lip and the angled front base tip is substantially larger than the width of the floor covering edge portion. The well rounded depending lip provides no sharp corners or edges to impede the sliding of the floor covering up and into the channel. The lower sections of the back wall are of such an upward angle so as to cause the upward deflection of the floor covering material being slidably inserted. The smooth upwardly flaring inside channel wall will force the upwardly extended edge portion of the floor covering to slide tightly into an acute inside angle, where the floor covering would then be held firmly aganist the back wall and against the lower angled sections. The flat straight surfaces of the sectionally divided back wall will cause the curved rounded back surface of the floor covering to bridge the joints between each section of the back wall and the joint between the flooring and the base tip. This bridging creates extremely slight voids of contact or troughs extending the length of the back wall sections where additional adhesive will form where improved bonding qualities will result. The sectionally divided back wall surfaces are also roughened and porous to further enhance the holding qualities of the floor covering adhesive.

Referring now to FIG. 2B, where the enlarged cross-sectional view of the bathtub base form and of the Magee wall to floor cove baseboard are shown side by side. Improvements and other modifications to portions of the Magee patent as found in the bathtub wall form are listed and described as follows:

(a) The front wall above the depending lip portion is a smooth, easily cleaned surface.
(b) The depending lip portion is smooth and rounded.
(c) The upper inside channel wall is smooth and flares upwardly and backwardly.
(d) The joining of the upper inside channel wall to the back wall is at a compound inside angle.
(e) The entire channel back wall is sectionally divided, having all sections roughened and slightly porous.
(f) The flat surfaces of the sectionally divided back wall join at angles of more or less thirty degrees.
(g) The base and outside back wall are self contained and require no adjacent supporting wall.
(h) The upper portion is encased in a bathtub front wall and requires no application of other materials.

Referring now to FIG. 3, there is shown a cross sectional view of the wall form 51, where the back bathtub wall continues upward to where the thin upper edge of the wall turns downward at a slight angle providing a tapering back wall 62 with increasing depth and thickness. This tapered back wall is of sufficient strength to support the weight along the back and ends of the bathtub. This tapered back wall contains a plurality of elongated, preformed mounting slots 68 placed close enough to provide adequate attaching capabilities of the bathtub to structural wall members with the use of screws or nails 70. The angle of contact of the tapering back wall to the structural wall members is slight enough to allow the installed over-lapping drywall 20 to fit closely enough to eliminate the bulge normally found there. Approximately half way down the tapered back wall, a sloping shelf 60 extends outwardly at sufficient distance to support the lower edge portion of the drywall above the moisture of the planar surface of the bathtub. The front supporting wall of the sloped shelf forms the back wall 58 of the wall tile groove 50. The tile groove back wall joins, at a right angle, the planar surface of the bathtub, thus using that surface for the bottom 52 of the tile groove. The inside of the front tile groove wall 54 is spaced so as to provide adequate width for the insertion of wall tile or other wall covering material. The front tile groove wall 56 is of sufficient depth to provide adequate coverage and holding of the lower edge of an inserted wall tile. The upper portion of the front tile groove wall slopes slightly outward to a point where it then gently tapers downward and outward to the planar surface of the bathtub. The bottom of the inside surfaces of both the front and the back tile groove walls are roughened and porous so as to improve adhesive holding qualities.

Referring now to FIG. 4, there is shown an enlarged diagram of the upper left-hand front facing portion of the bathtub where the wall form is shown extending, at a right angle, down the front wall of the bathtub. In the turning down of the wall form, the sloped drywall shelf and the front and back walls of the wall tile groove have the same reference to the bathtub front wall surface as they do the upper planar surface. The elongated anchoring slots are shown in the tapered back wall as it turns and continues down the front surface at the bathtub. The advantages of the wall form at this outside front corner and front tub wall are:

(a) The tapered back wall provides a sturdy foundation to overlap and abut drywall to thusly eliminate the drywall unsupported edge portion normally found at the bathtub corner and down the front wall.
(b) The square angle eliminates the time consuming problem of cutting the drywall to fit the rounded surface of the bathtub corner.
(c) The sloped shelf holds the drywall away from the corner of the bathtub protecting it from the moisture usually found there.
(d) Tile setting or other wall covering installations have always been difficult at this rounded corner of a bathtub. The straight line, right angle as provided will lessen the installation problems and enhance the appearance.
(e) The elimination of a joint requiring grout or caulking will provide for better water proofing, much less continued maintenance, and a better, neater appearing installation.

Referring now to FIG. 5 showing the lower left-hand facing end of the bathtub depicting the joining of the wall form and the base form, showing the front tile groove wall terminating at the lower portion of the smooth rounded depending lip. The tile groove back wall continuing in under the depending lip portion and joining the upper inside channel wall and the back sectionally divided wall creating a water-tight inside corner. The sloped drywall shelf, the back tile groove wall, and the tapered back wall continue downward and terminate at the flooring level.

After the bathtub is set, leveled, and attached to the wall studs or other wall structural members, the following sequence takes form. The drywall is hung to the wall overlapping the back tapered wall both above and in front of the bathtub where it is either abutted or cut to the sloped drywall shelf. The drywall is extended to the flooring level. Upon completion of the drywall installation, the floor covering is installed. It is slid tightly upwardly into the base form channel and cut tightly to the lower portion of the wall form at each end of the bathtub. Wall tile or other wall covering material is then installed over the wall surfaces above the back and end of the bathtub, as well as down the front edges of the bathtub front wall. The front sloping tile groove wall has now replaced the caulking line on the planar and front wall surfaces of the bathtub. The floor covering edge portion is tucked securely up and behind the depending lip portion of the bathtub front wall, thus eliminating the caulking line at the front of the bathtub.

SUMMARY, RAMIFICATIONS, AND SCOPE

Accordingly, it can be seen that this invention improves the waterproofing qualities of all lines of contact between a bathtub and its surrounding walls and flooring. The continued need to caulk these lines of contact is eliminated, thus removing the unsightly mess of poorly caulked joints, as well as the continued problem of cleaning them out and recaulking.

In addition, neater and cleaner joints are created, thus enhancing the overall appearance of the bathtub and surrounding floors and walls. Further, this improved bathtub has the additional advantage in that

- it provides a bathtub that is easy and quick to install, one that needs no added material or labor to give it waterproof qualities;
- it provides the bathtub owner with the water-tight integrity of the attached preformed walled bathtubs and yet gives them the ability to choose from the unlimited styles, sizes, and colors available in today's many types of wall covering;
- it provides a bathtub that will eliminate the usual settling of the bathtub to the floor, thus doing away with the separation between wall tile and tub;
- it provides a bathtub with straight edges, square corners, and supporting front flanges for the drywall installer to work to, and accordingly, a quicker and better fitting job will result;
- it provides a gently tapering inside back wall where the overlapping drywall will join closely, thus eliminating the poor fitting joint where drywall either abuts to or overlaps the upper end of the upturned flange of conventional plastic or steel bathtubs;
- it provides a bathtub that will hold the drywall above and away from the top planar surface of the bathtub, helping to keep it dry, even should the water penetrate the adhesives at this level;
- it provides a bathtub with a tile or wall covering groove, with straight level lines and right angles to work with that, by eliminating the rounded shoulders, thus provides the wall covering installer with improved working conditions and insuring a better appearing and a more serviceable installation;
- it provides a bathtub with a base form that is an intricate part of the bathtub, that has improved bonding surfaces and elongated adhesive troughs to insure adequate bonding qualities of the adhesive;
- it provides a base form with a tapered upper inside channel that will force the upwardly extended edge of the floor covering into the compound inside angle, where it will be held tightly against the back wall of the channel;
- it provides an appealing, easily cleaned way of joining the floor covering at the base of the bathtub front wall; and
- it provides an improved bathtub where all lines of contact between the bathtub, and the surrounding adjacent surfaces are relocated where they are covered and protected from water penetration.

Even though the description above contains many specifics, these should not be construed as limiting the scope of the invention, but merely provide illustrations of some of the presently preferred embodiments of this invention. For example, the sloped drywall shelf can be eliminated in bathtub models built for commercial use where the drywall is installed prior to setting the bathtub; the width and length of the drywall shelf can be changed; the smooth rounded dependent lip can be raised or lowered; the mounting holes can have other shapes; the wall form may be used independently of the base form or the bathtub; and each may be used independently of the other.

Thus, the scope of the invention should be determined by the appended claims and their legal equivalents, rather than by the examples given.

Through prior art and conventional knowledge, there are found various methods of mounting bathtubs to the wall with an assortment of brackets, bars, and trim. There are countless types of moldings that are designed to be attached to, around, and over the joints between wall and bathtub. Cove stick and or metal floor coving devices are in evidence. Many different means of adapting metals, wood, building materials, etc. to specially constructed bathtubs are shown. Numerous forms of grouting, caulking, and otherwise filling or covering the joint between a bathtub fixture and its adjoining surfaces have been devised, with some still in limited use. Herewith, with this common knowledge in mind, I respectfully claim the following:

I claim:

1. In a bathtub, a base form for covering the joint formed between a front wall of said bathtub and an adjacent horizontal floor covering surface, said base form is made of the same material as, said bathtub and formed as a one piece construction therewith and extends lengthwise above a lower end of the front bathtub wall, wherein said base form includes an inverted channel with an opening in a front surface at a lower end position of said base form, said channel extending inwardly and upwardly from said opening to provide a smooth, rounded depending lip portion above said channel with an overhanging elevated edge, said further providing a lower smooth upper surface that flares upwardly and inwardly joining a sectionally divided back wall at an obtuse inside angle, said channel and opening being sized to slidably receive an inwardly and upwardly extending edge portion of a floor covering received in said channel and overlapping said lower surface whereby moisture present on the outside of said bathtub wall is directed down along said front wall and will drain downwardly and away from said floor covering edge portion in said channel.

2. In a bathtub, said base form as set forth in claim 1, wherein said depending lip portion is provided with an overhanging, elevated, smooth, rounded edge that is disposed a selected distance above said lower smooth upper surface.

3. In a bathtub, said base form as set forth in claim 1, wherein said depending lip portion includes an upper inside wall within said channel which has a smooth surface that flares upwardly and rearwardly from said elevated edge to where said upper inside wall joins, at an acute angle, an upper portion of said sectionally divided back wall.

4. In a bathtub, said base form as set forth in claim 1, wherein said sectionally divided and back wall comprises flat, straight, elongated surfaces that are joined to each other at approximately thirty degree angles, and where said lower smooth upper surface is angled with respect to the flooring at about the same angle.

5. In a bathtub, said base form as set forth in claim 4, wherein said flat, straight, elongated surfaces do not align perfectly to a curved or rounded adjacent surface, thus leaving, at a floor joint and all joints between the back sections, small voids of contact or shallow troughs which run the length of said sectionally divided back wall.

6. In a bathtub, said base form as set forth in claim 1, wherein said flexible floor covering, when inserted, will be deflected to move to an upwardly extending overlapping position with said lower smooth, rounded upper surface and sectionally divided back wall.

7. In a bathtub, said base form as set forth in claim 1, wherein said sectionally divided back wall surfaces are roughened and slightly porous, so as to enhance bonding qualities.

* * * * *